US005857930A

United States Patent [19]

Troncoso

[11] Patent Number: 5,857,930

[45] Date of Patent: Jan. 12, 1999

[54] HUNTING ARROW POINT

[76] Inventor: Vincent Troncoso, 14090-6100 Rd., Montrose, Colo. 81401

[21] Appl. No.: 858,805

[22] Filed: May 19, 1997

[51] Int. Cl.[6] ..... F42B 6/08

[52] U.S. Cl. ..... 473/583

[58] Field of Search ..... 473/578, 582, 473/583, 216, 219, 221

[56] References Cited

U.S. PATENT DOCUMENTS

| | | | |
|---|---|---|---|
| 2,568,417 | 9/1951 | Steinbacher | 473/583 |
| 3,036,396 | 5/1962 | Swails | 473/582 X |
| 3,600,835 | 8/1971 | Hendricks | 473/582 X |
| 5,458,341 | 10/1995 | Forrest et al. | 473/583 |
| 5,564,713 | 10/1996 | Mizek et al. | 473/583 |
| 5,570,530 | 11/1996 | Lee | 473/582 |

*Primary Examiner*—John A. Ricci
*Attorney, Agent, or Firm*—Donald E. Nist

[57] ABSTRACT

The improved hunting arrow point includes an elongated preferably generally frusto-conical aerodynamic main body defining a central longitudinal slot extending from near the rear end of the body to the front end thereof and a front tip releasably secured over the front end of the main body. The tip has a rearwardly extending pin which fits into the slot and supports the front end of the main body. At least two flat cutting blades are rotatably secured at their rear ends in the rear portion of the slot for rotation between a collapsed forward position abutting the front tip and an operative cutting position wherein they extend outwardly and rearwardly of the slot for cutting the flesh of an animal pierced by the point. The blades bear integral detents which releasably secure the blades in the collapsed position. The blades have laterally extending front pusher tips which facilitate opening of the blades to the cutting position when an animal is pierced by the point. The rear end of the main body includes a connector for releasably attaching it to the front end of a hunting arrow shaft.

5 Claims, 1 Drawing Sheet

HUNTING ARROW POINT

BACKGROUND OF THE INVENTION

1. Field Of The Invention

The present invention generally relates to sport equipment and more particularly to an archery hunting arrow point of an improved type.

2. Prior Art

Most conventional archery hunting arrow points employ fixed laterally extending razor blades and the like to cause maximum cutting and bleeding damage when an animal is hit by a hunting arrow bearing the point. Such points are dangerous to carry because of the exposed fixed razor blades. Moreover, there is some hazard involved in screwing the points onto the front of a hunting arrow shaft and removing the points when damaged, for example, when the arrow misses the target and strikes a bush or tree. Moreover, the fixed laterally extending blades adversely affect the proper rotation of the hunting arrow during flight and may result in the arrow missing the target.

Newer, safer hunting arrow points solve this problem by using razor blades which collapse into the point before the arrow is shot and which deploy to the cutting position only when the target is struck. These newer points also have their disadvantages, however. In most instances they are held in the collapsed position by external rubber bands which are easily broken before or during use and must be replaced with some degree of difficulty in order for the razor blades to function properly. Moreover, the rubber bands can slip rearwardly on the point to a non-biasing position and must be maneuvered into place in order to operate properly.

Certain other hunting arrow points employ springs and other complicated mechanisms for deploying the razor blades, but substantially increase the cost of the points and are not easily replaced when damaged during use of the points. Furthermore, most points which bear deployable razor blades in central cavities are structurally weak at their front ends and can easily become twisted and break in use. Moreover, most such points do not have replaceable front tips which are the most easily damaged components of hunting arrow points.

Accordingly, there remains a need for an improved archery hunting arrow point which is simple, inexpensive and durable and which does not require the use of rubber bands, springs and the like to properly deploy razor blades housed in the point. Such point should also include a reinforced front end and a removeable tip for optimum utility.

SUMMARY OF THE IMPROVED HUNTING ARROW POINT OF THE PRESENT INVENTION

The improved archery hunting arrow point of the present invention satisfies all the foregoing needs. The point is useable with compound and recurved archery hunting bows and also with crossbows and other specialty hunting bows. The point is simple, durable, efficient, inexpensive and safe to install, carry on a hunting arrow shaft and use. It includes easily replaceable components.

The point includes an elongated preferably frusto-conical main body of aluminum, steel or the like and having a rear extension for releasably securing it to the front end of a hunting arrow shaft, and an elongated central slot extending from adjacent the rear end of the main body to the front end thereof. The slot houses a plurality, preferably two, of flat blades with sharp cutting surfaces, which blades are secured in the slot by a crosspin passing through the rear ends of the blades to permit their rotation between a forward collapsed position wherein their cutting surfaces are concealed in the slot and a rearward operative cutting position wherein they extend laterally and rearwardly with their cutting surfaces exposed.

Detents in the form of integral protrusions or pins extending laterally from the flat sides of the blades adjacent their rear ends releasably frictionally hold the blades in engagement with the main body in the collapsed position until the point strikes a target. The main body has a front tip releasably secured thereto and the front portions of the blades abut the sides of the front tip when in the collapsed position.

The front tip has a rearwardly extending central pin which is disposed within the front end of the slot, thereby acting as a guide for attachment of the tip to the front end of the main body and for reinforcing the front end of the main body against damage. The front tip may also be dimensioned to bias the front end of the main body against the pin in order to increase the pin's reinforcing properties.

In order to cause the blades to deploy to the operative cutting position, the front ends of the blades have forwardly and laterally extending pusher tips which bids the blades to the open position when a target is struck. Preferably, these pusher tips are at about a 30 degree forward angle to maximize their opening effectiveness and minimize wind drag and are integral with the remainder of the blades.

Further features of the improved archery hunting arrow point of the present invention are set forth in the following detailed description and accompanying drawings.

DRAWINGS OF A PREFERRED EMBODIMENT OF THE IMPROVED HUNTING ARROW POINT OF THE PRESENT INVENTION

DETAILED DESCRIPTION OF THE INVENTION

Figure 1:
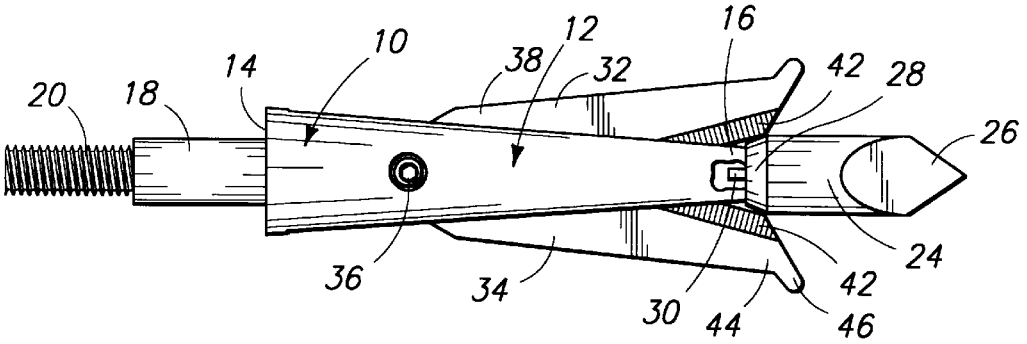
FIG. 1 is a schematic side elevation, partly broken away, of a preferred embodiment of the improved archery hunting arrow point of the present invention, showing the point in blade-collapsed arrow shooting position.
Figure 2:
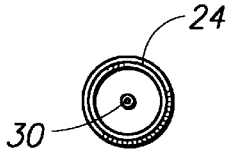
FIG. 2 is a schematic rear elevation of the front tip of the point of FIG. 1.

FIGS. 1–5:

Now referring more particularly to FIGS. 1 to 5 of the drawings, a preferred embodiment of the improved archery hunting arrow point of the present invention is schematically depicted therein. Thus, point 10 is shown which comprises a main body 12 having an elongated configuration, preferably tapering from a broad rear end 14 to a narrow front end 16 in an aerodynamically shaped generally frusto-conical configuration. Rear end 14 has a rearwardly extending connector 18 with a threaded rear portion 20 adapted to be releasably threadably received into the front end of an archery hunting arrow shaft.

Main body 12 has a slot 22 therein extending from adjacent rear end 14 to front end 16 and disposed along the longitudinal axis of main body 12. A front tip 24 having one or more pointed cutting surfaces 26 is releasably threaded on to the exterior of front end 16.

Figure 4:
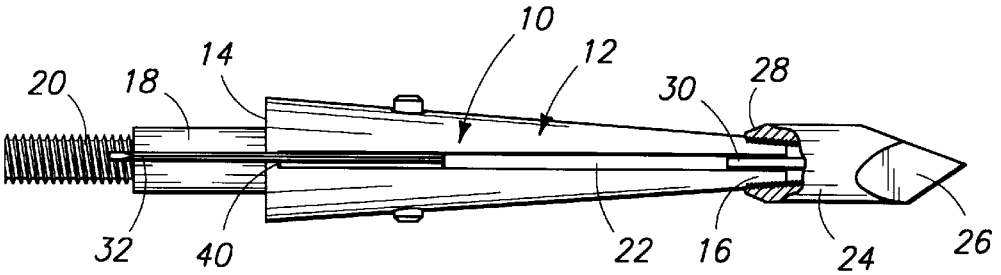
FIG. 4 is a schematic top plan view of the archery hunting arrow point of FIG. 3, showing a blade thereof in the operative cutting position; and, FIG. 5 is an enlarged fragmentary schematic top plan view of one of the cutting blades of the point of FIG. 1, showing a protruding side pin which functions as a frictional detent.
Figure 5:
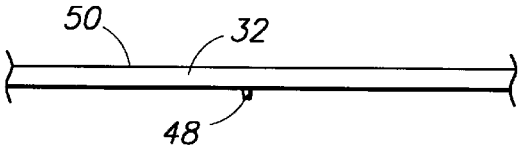

The rear end 28 of front tip 24 has a central elongated pin 30 which extends rearwardly therefrom into slot 22 to guide, brace and reinforce front end 16 of body 12, as shown in FIG. 4. Front tip 24 may also be dimensioned with respect to front end 16 to force front end 16 against pin 30 when being threaded on front end 16, thus increasing the strengthening effect of pin 30 on front end 16. It will be understood that because of slot 22 front end 16 would otherwise be a weak part of point 10, but is not so because of pin 30.

Point 10 also includes a pair of flat cutting blades 32 and 34 rotatably secured in slot 22 by a crosspin 36 through their rear ends 38 and into main body 12 adjacent the rear end 40 of slot 22. Blades 32 and 34 are generally wedge-shaped with cutting surfaces 42 on what become the front areas of blades 32 and 34 when blades 32 and 34 are extended from opposite sides of slot 22 and into the operative cutting position shown in FIG. 3.

Figure 3:
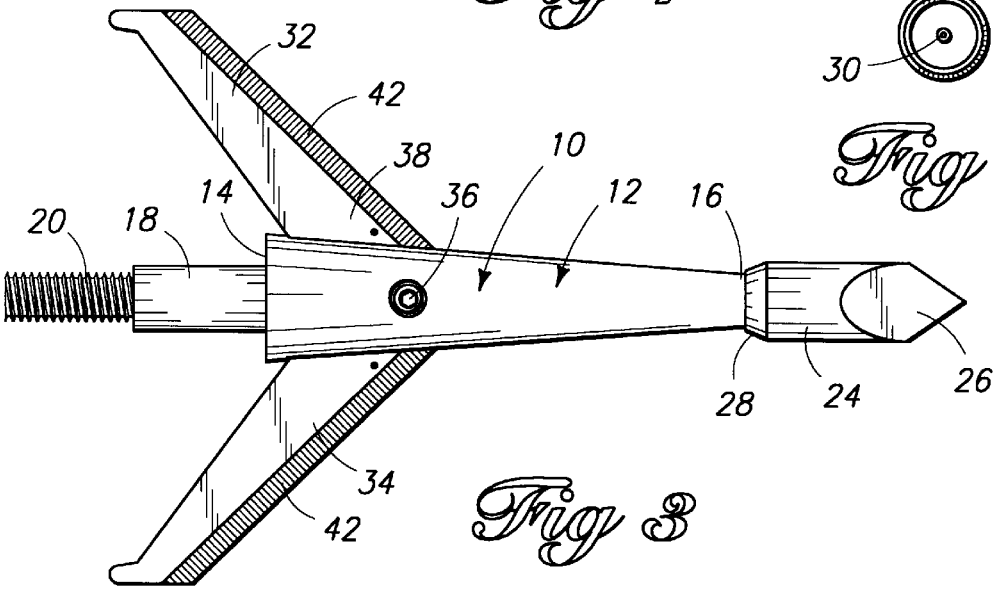
FIG. 3 is a schematic side elevation of the archery hunting arrow point of FIG. 1, showing the blades of the point in the operative deployed cutting position.

Thus, blades 32 and 34 can be rotated between the operative position of FIG. 3 and the stored or collapsed position of FIG. 1. In the stored position blades 32 and 34 do not interfere in any way with the proper flight of a hunting arrow to which point 10 is attached. In the stored position the front edges of cutting surfaces 42 abut the perimeter of front tip 24 adjacent its rear end 28.

It will be noted that the front ends 44 of blades extend forwardly and laterally at preferably about a 30 degree angle to form front pusher tips 46. It will also be noted that blades 32 and 34 have integral protrusions or pins 48 extending laterally outwardly from at least one side 50 of each blade at the rear end thereof. Protrusions 48 frictionally releasably secure blades in the collapsed or stored position of FIG. 1 by causing blades 32 and 24 to bind against each other and against main body 12 adjacent the rear end of slot 22. However, when a target is struck by point 10, front tip 24 penetrates the target first and then the target is struck by pusher tips 46, the net effect of which is to open blades 32 and 34 into the operative cutting position of FIG. 3, slicing the target animal and causing maximum bleeding and tissue damage. Blades 32 and 34 are dimensioned such that they cannot collapse rearwardly past the operative position of FIG. 3 because they bear against the rear end 40 of slot 22.

Accordingly, point 10 has an improved construction and function over conventional arrow hunting points. Point 10 can be fabricated from strong metal, such as aircraft aluminum or steel, titanium or the like for long-term use. Blades 32 and 34 can be swung into the operative position and can be sharpened as needed. Blades 32 and 34 can be removed and replaced, as needed, by removing front tip 46 and crosspin 36. Further features of the invention are as set forth in the foregoing.

Various modifications, changes, alterations and additions can be made in the improved hunting arrow point of the present invention, its components and parameters. All such modifications, changes, alterations and additions as are within the scope of the appended claims form part of the present invention.

What is claimed is:

1. An improved hunting arrow point, said point comprising, in combination:

a) an elongated main body having a rear end and an opposite front end, said main body having a rear extension for releasably securing said point to the front end of a hunting arrow shaft, said main body defining a central longitudinal slot extending from adjacent said rear end to said front end;

b) a hunting arrow point front tip releasably secured to said front end of said main body, said tip having a front nose bearing at least one flesh-penetrating sharp surface, said tip having a rear end and a strengthening and aligning member extending rearwardly from said rear end of said tip and into the front end of said slot to guide and support said main body;

c) a plurality of blades, each said blade being elongated and generally flat with inner and outer sides and having at least one sharp cutting surface, said blades at about their rear ends being secured in said slot for rotation between a collapsed forward position wherein said blades abut said tip and an operative cutting position wherein said blades extend laterally and rearwardly of said main body for cutting the flesh of an animal pierced by said point, said blades having cutting surfaces abutting said tip in said collapsed position and extending on the leading edges of said blades when said blades are in said cutting position, said blades having laterally directed front pusher tips which engage the flesh of an animal during said piercing and cause said blades to rotate to said cutting position, said main body including stop means for preventing rearward collapse of said blades from said cutting position, said blades including detents which releasably secure said blades in said collapsed position until an animal is pierced by said point, said detents comprising protrusions extending from said blade sides adjacent the rear end thereof to engage at least one of 1) said blades and 2) the portions of said main body which define said slot.

2. The improved hunting arrow point of claim 1 wherein said slot narrows from the rear end thereof to the front end thereof to facilitate operation of said protrusions in releasably holding said blades in said collapsed position.

3. The improved hunting arrow point of claim 2 wherein said tip screws over said front end of said main body, biasing said front end of said main body against said tip strengthening member and narrowing said slot.

4. The improved hunting arrow point of claim 1 wherein said protrusions comprise pins inserted transversly through said blades and wherein said main body includes a transverse pin through said slot and to which said blades are secured for rotation.

5. The improved hunting arrow point of claim 4 wherein said blade front pusher tips slope outwardly from the longitudinal axis of said point at an angle of about 30 degrees and wherein said main body is generally frusto-conical.

* * * * *